US007784134B2

(12) United States Patent
Emrich

(10) Patent No.: US 7,784,134 B2
(45) Date of Patent: Aug. 31, 2010

(54) METHOD FOR LAYING A MILITARY BRIDGE

(75) Inventor: Lothar Emrich, Rehweiler (DE)

(73) Assignee: General Dynamics European Land Systems-Germany GmbH, Kaiserslautern (DE)

( * ) Notice: Subject to any disclaimer, the term of this patent is extended or adjusted under 35 U.S.C. 154(b) by 282 days.

(21) Appl. No.: 12/156,833

(22) Filed: Jun. 5, 2008

(65) Prior Publication Data

US 2009/0064427 A1 Mar. 12, 2009

(30) Foreign Application Priority Data

Jun. 5, 2007 (DE) ..... 10 2007 026 275

(51) Int. Cl.
*E01D 15/12* (2006.01)
*E01D 15/10* (2006.01)
*E01D 21/00* (2006.01)
*G05D 1/00* (2006.01)

(52) U.S. Cl. ..... 14/2.5; 14/2.4; 14/77.1; 701/2; 701/28

(58) Field of Classification Search ..... 14/2.4, 14/2.5, 77.1; 701/2, 28; 703/1, 6, 7, 8; 382/153, 382/104; 356/601, 607, 608
See application file for complete search history.

(56) References Cited

U.S. PATENT DOCUMENTS 2,636,197 A * 4/1953 Odot ..... 14/2.6
4,602,399 A * 7/1986 Jenkins ..... 14/2.4
5,443,584 A * 8/1995 Diefendahl et al. ..... 14/2.4
6,728,608 B2 * 4/2004 Ollis et al. ..... 701/28
7,174,591 B2 * 2/2007 Bertrand et al. ..... 14/2.5
7,603,235 B2 * 10/2009 Makela et al. ..... 701/301
2008/0269960 A1 * 10/2008 Kostmann ..... 701/2
2009/0076665 A1 * 3/2009 Hoisington et al. ..... 701/2
2009/0076666 A1 * 3/2009 Schneider et al. ..... 701/2
2009/0125163 A1 * 5/2009 Duggan et al. ..... 701/2
2009/0276105 A1 * 11/2009 Lacaze et al. ..... 701/2
2009/0326735 A1 * 12/2009 Wood et al. ..... 701/2
2010/0030473 A1 * 2/2010 Au et al. ..... 701/301

* cited by examiner

*Primary Examiner*—Thomas B Will
*Assistant Examiner*—Abigail A Risic
(74) *Attorney, Agent, or Firm*—Lucas & Mercanti, LLP; Klaus P. Stoffel

(57) ABSTRACT

A method for laying a military bridge over an obstacle in a combat zone with using at least one laying vehicle. First, the bridge is loaded on a self-propelled, unmanned, remote-controlled laying vehicle and transported to the edge of the combat zone by water, air, rail, and/or road. From this point, the laying vehicle with the bridge is guided by a manned pilot vehicle to the vicinity of the obstacle. The laying vehicle then begins an automatic slow approach to the obstacle, for which purpose the laying vehicle has a suitable optical system or a laser scanner. At the edge of the obstacle, the topographical situation is scanned. On the basis of the scanner data, the laying operation is simulated, taking into consideration the predetermined design limits. On the basis of the simulation results, a decision is made about whether the laying operation will be carried out or broken off. This decision is then executed.

16 Claims, 2 Drawing Sheets

METHOD FOR LAYING A MILITARY BRIDGE

BACKGROUND OF THE INVENTION

The invention concerns a method for laying military bridges over an obstacle in a combat zone with the use of at least one laying vehicle.

The laying of military bridges over obstacles that are within the range of fire of the enemy is a difficult and above all a dangerous undertaking. Originally, it was necessary for combat engineers to lay bridges for overcoming obstacles on site. This resulted in heavy losses. Therefore, several decades ago a method for laying bridges of this type was developed, in which a tank that had been converted to a laying vehicle moved a bridge that had been broken down into several components to the edge of the obstacle and then laid it over the obstacle by cantilever construction. These bridges were capable of spanning obstacles up to 28 m wide. The operating crew was basically able to stay seated in the tank, although it was sometimes necessary to leave the tank for short periods of time to correct malfunctions.

Bridge systems of this type are now categorized under the general term of "assault bridges". Due to the necessary armor plating of these vehicles, systems for active protection are dispensed with for the benefit of the useful load requirements for the bridge and laying vehicle, and passive protection is reduced. On the other hand, bridges without direct exposure to enemy action are referred to as "tactical bridges" or "support bridges". Systems of this type usually have a greater capacity with respect to the clear span and thus a greater weight. Therefore, it makes sense to use only systems with no protection for transport.

All assault bridges have in common that the laying operation must be activated and controlled by one or more soldiers at the site. Therefore, these soldiers are still exposed to enemy fire.

Another problem in the development of military bridges is transportability. There are usually limitations with respect to useful load, trailer load, total weight, and dimensions. Armored vehicles place high demands on the bridge system, since they themselves already take up a good deal of the available weight limits and structural dimensions. Therefore, the bridges were designed in such a way that they could be folded up or pushed together for transport. A number of designs were also developed for this. However, these designs have in common the fact that they complicate the design and slow the laying operation.

Analogously, the same considerations also apply if the bridge is transported by water or air. Here too, it is necessary to comply with the respective transport profiles, and in the case of air transport, it is also necessary to maintain the limited permissible safe loads and transport weights.

SUMMARY OF THE INVENTION

The object of the present invention is to specify a method for laying military bridges, in which no soldiers are exposed to enemy fire. A further objective of the invention is to optimize the transport of the bridge to the site at which it is to be laid.

The aforesaid principal object is achieved by a method with the following steps:

loading the bridge 1 on at least one self-propelled, unmanned, remote-controlled laying vehicle 2, transporting the loaded laying vehicle by water, air, rail and/or road to the edge of the combat zone, guiding the one or more laying vehicles 2 by a manned pilot vehicle 6 to the vicinity of the obstacle 10, automatic slow approach of the one or more laying vehicles to the obstacle, supported by optical determination of the surroundings and/or laser scanner determination of the surroundings, scanning the topographical situation, simulation of the laying operation taking the scanner data and the predetermined design limits into consideration, making a decision about whether to carry out or break off the laying operation.

The present invention is based on the following principles:

First, the whole travel distance to the site at which the bridge is to be laid is divided into three hazard zones according to the risk posed by enemy action:

Zone 1: Advancing Zone

In this zone there is no direct enemy action, and the vehicles move in a closely monitored area.

Zone 2: Combat Zone

Only vehicles with active and passive protection move in this zone.

Zone 3: Installation Zone

This zone is located directly in front of enemy units and is critical even for armored vehicles.

The spatial extent of these zones is defined according to military principles in each individual case.

To move the bridge system into the advancing zone, the bridge is loaded onto a laying vehicle. The laying vehicle is basically self-propelled but is initially moved by a transport vehicle. This transport vehicle is a military vehicle, although civil vehicles could also be used if necessary, and can move by road, rail, water, or air. In the advancing zone, the laying vehicle is used only as a carrier and is otherwise passive. In this regard, the vehicle movements are conventionally controlled by the systems of the transport vehicle. At the edge of the combat zone, the laying vehicle is separated from the transport vehicle.

At this point, a pilot vehicle takes over the guidance of the laying vehicle, on which the bridge is loaded, towards the obstacle that is to be bridged. During this operation, there is preferably no mechanical connection between the pilot vehicle and the laying vehicle. The laying vehicle drives actively, i.e., with its own motive power and unmanned. The pilot vehicle is manned and preferably armored. Since the laying vehicle is not mechanically coupled with the pilot vehicle, the pilot vehicle has its complete independence and mobility.

The pilot vehicle can thus be similar in active and passive protection to regular combat force vehicles or may actually be such a vehicle. The laying vehicle is connected with the pilot vehicle by an electronic guidance system and follows its movements independently at an appropriate (predetermined) distance until it reaches the installation zone.

From this point on, the laying vehicle moves independently as a robotic vehicle until it reaches the obstacle. This is possible thanks to the system that is built into it for scanning the surrounding area. This system can comprise both optical image analysis and laser scanners. Once it arrives at the obstacle, it measures the width of the obstacle and the shape of the bank. Using the data thus acquired, the laying vehicle then first carries out a simulation of the laying operation. If this simulation leads to the determination that the obstacle is too wide or the bank is too steep, it terminates the laying operation. Otherwise, it carries out the laying operation.

Since in the actual installation zone of the bridge system in the vicinity of the obstacle, neither pilot vehicles nor personnel are present and the laying vehicle is completely unmanned, misinterpretations that could lead to malfunctions are eliminated. If necessary, corrective actions can be taken from the pilot vehicle at a safe distance from the laying vehicle. In addition, no personnel can be harmed by enemy fire. Since no one is on board, the laying vehicle can be unarmored or only lightly armored. This is also a benefit with respect to the load that can be carried, i.e., large, heavy bridge members can be transported and laid.

To make it possible for these large and heavy bridge members to be transported to the combat zone without exceeding the given road profiles, bridge profiles, and other profiles, and thus to achieve the aforementioned second objective of the invention, the bridge is divided lengthwise, and each section of the bridge is loaded onto its own laying vehicle. If the bridge is to be transported as air cargo, each laying vehicle with its loaded bridge section can be transported in separate airplanes.

In accordance with an alternative embodiment of the invention, the laying vehicle is guided from the edge of the combat zone to the obstacle zone, not by a single pilot vehicle but rather by a group of pilot vehicles. In this way, the passage of the laying vehicle to the obstacle is not disrupted if one of the pilot vehicles is put out of commission by enemy fire. Several pilot vehicles are also capable of more quickly finding a suitable place for overcoming the obstacle. If one of the pilot vehicles has found a place that seems suitable for overcoming the obstacle, then the laying vehicle follows that pilot vehicle. The pilot vehicles have recorded their route by a universal position finding system and transmit the most favorable route to the laying vehicle by telemetry. Using this data and its own scanning system, the laying vehicle can then find the obstacle on its own. Once it has arrived at the obstacle, the laying vehicle then carries out, again, on its own, the slow approach, the measurement, the simulation, and, finally, the laying of the bridge.

In a modification of the invention, the slow approach to the obstacle is made at reduced speed and, finally, at incremental speed. This prevents the laying vehicle from going beyond, for example, the edge of a ravine and sustaining damage.

In accordance with a refinement of the invention, after the bridge has been laid, the laying vehicle performs an inspection of the laid bridge.

As the laying vehicle is approaching the edge of the obstacle, as soon as its own topographical scanning system detects a gradient in the local terrain that is too great for it to negotiate, the approach is stopped. Depending on circumstances, the laying operation can be stopped altogether or a new attempt can be made in another place.

However, since it is possible that the indicated gradient is the result of an evaluation that was too rough, in accordance with a further refinement of the invention, the topographical scanning system is switched to short distance, and the approach operation is renewed.

Similarly, the laying operation can be stopped as soon as the topographical scanning system detects a ground level difference that exceeds the permissible longitudinal slope of the bridge.

Here again, there is the possibility of reassessing the situation by a fine scan in the standing position and then starting the laying simulation.

Finally, there is the possibility of wireless transmission of the topographical scanning data from the laying vehicle to a pilot vehicle. In the pilot vehicle, which is located at a safe distance from the laying vehicle, a soldier can further assess the situation and then wirelessly transmit command data to the laying vehicle. In this way, situations that overtax the logic integrated in the laying vehicle can be dealt with successfully.

The invention is explained in greater detail below with reference to the specific embodiment illustrated in the drawings.

DETAILED DESCRIPTION OF THE INVENTION

Figure 1:
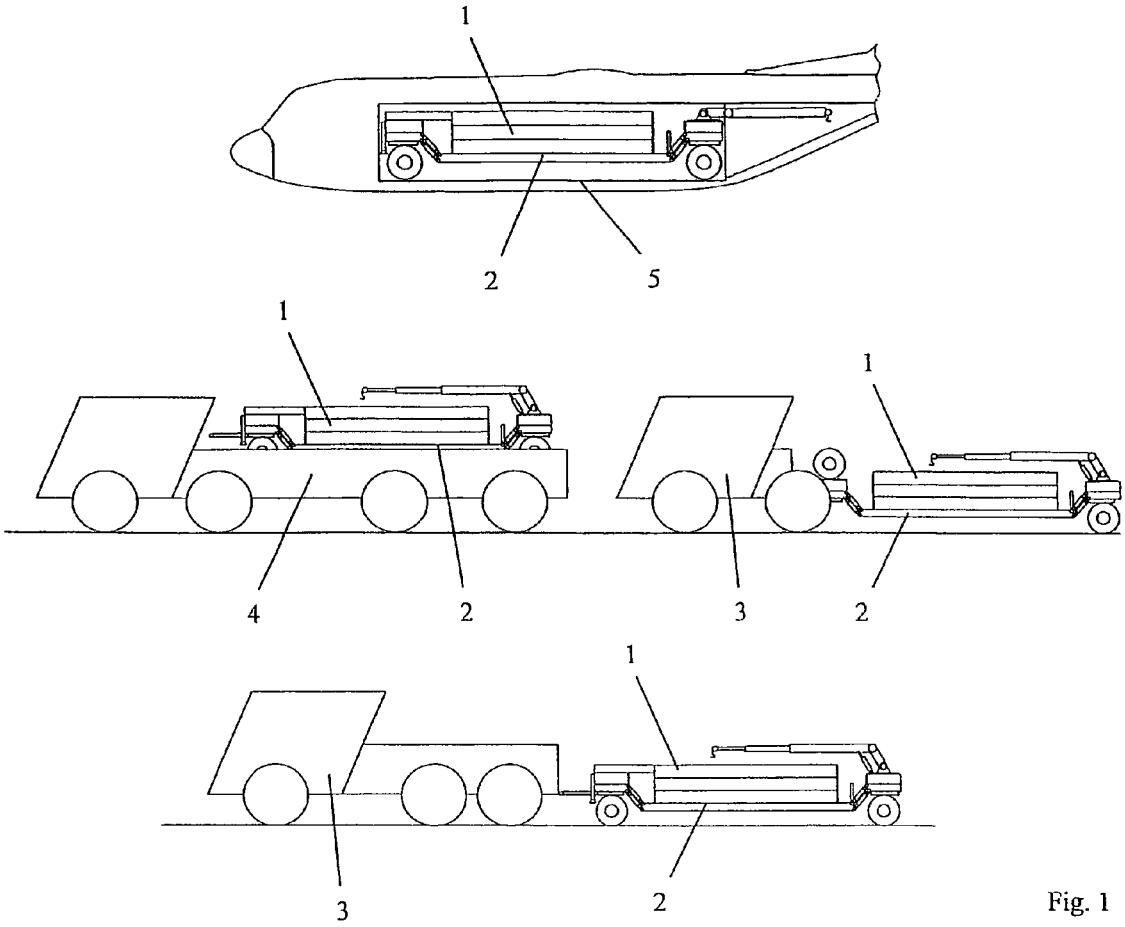
FIG. 1 shows self-propelled transport vehicles in the advancing zone, loaded with a laying vehicle that carries a military bridge, en route to an installation site.

FIG. 1 is a purely schematic representation of laying vehicles 2, loaded with a military bridge 1 and the associated equipment for laying the bridge. The laying vehicles 2 are self-propelled and equipped with their own topographical scanning systems, which comprise both optical means and laser scanners as well as a suitable electronic analysis system.

FIG. 1 also shows four examples of transport vehicles that allow rapid transport of the laying vehicle 2 loaded with the bridge 1 in the advancing zone to the edge of a combat zone. The first example is a tractor 3, to which the laying vehicle 2 is hooked as a trailer. In the same way, a cabin can also be adapted to the laying vehicle as a control module. The second example is a suitable special truck 4 or better a standard PLS transporter (PLS=pallet load system), which carries the whole laying vehicle 2 with the bridge 1. The third example is a cargo plane 5. The fourth example is a standard military tractor, to which the laying vehicle is mechanically hooked as a trailer.

Figure 2:
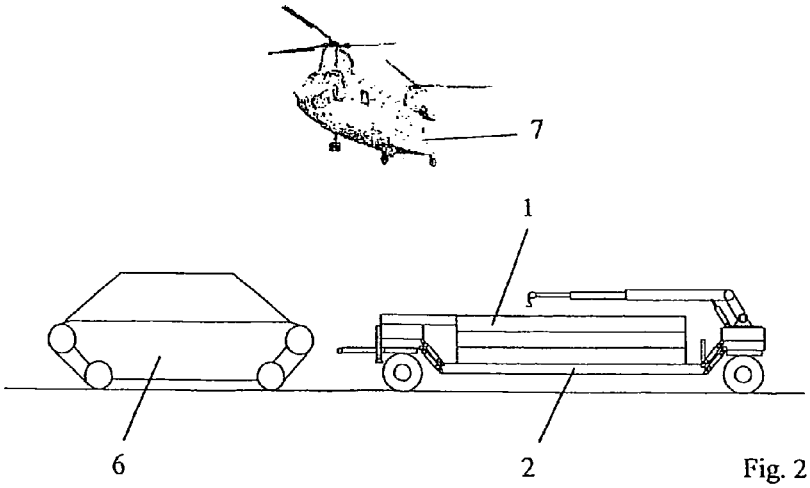
FIG. 2 shows the guidance of an unmanned, self-propelled laying vehicle in the combat zone to an expected obstacle.

After it has been brought to the edge of the combat zone by one of the transport vehicles 3, 4, 5, the laying vehicle 2, loaded with the bridge 1, is guided by a pilot vehicle to an obstacle 10 that is to be overcome. This is shown in FIG. 2. A tank 6 and a helicopter 7 are shown as pilot vehicles. The pilot vehicles 6, 7 have only wireless contact with the laying vehicle 2. The laying vehicle 2 drives itself, so that the pilot vehicles 6, 7 are not hindered in any way. They maintain their complete mobility, which ensures the survival of the operating crews seated in the pilot vehicles 6, 7.

Figure 3:
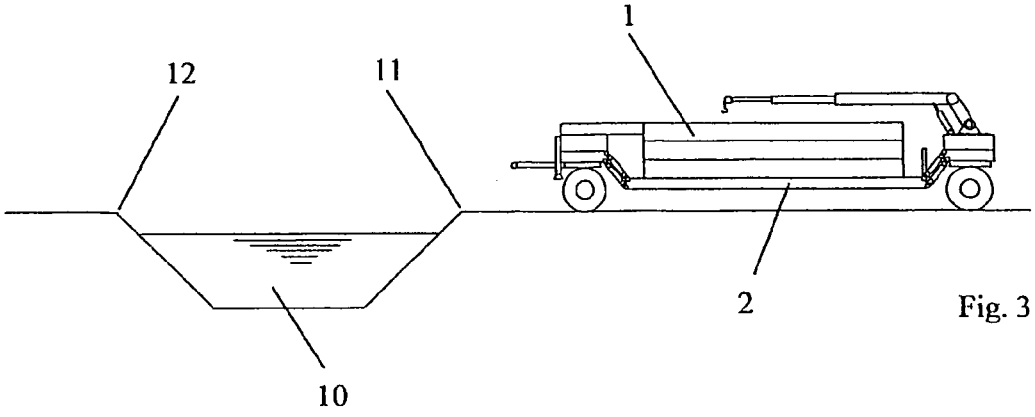
FIG. 3 shows an independently driving, unmanned laying vehicle in the installation zone during the approach to an obstacle.

The final approach to the obstacle 10 to be overcome in the installation zone is made without the pilot vehicle 6, 7. This is shown in FIG. 3. To this end, as has already been mentioned, the laying vehicle 2 is equipped with its own motive power and its own topographical scanning system. The laying vehicle 2 approaches the obstacle 10 with decreasing speed and, finally, at incremental speed, to prevent it from driving past or into the obstacle 10 and sustaining damage.

Once it has arrived at the edge 11 of the obstacle 10, the laying vehicle 2 makes measurements. These measurements determine the width of the obstacle 10 as well as the height level of the two edges 11, 12 of the obstacle 10. The laying vehicle 2 then uses these measurements data to carry out a laying simulation. If this simulation shows that the width of the obstacle 10 is less than the length of the military bridge 1 and that the difference in levels of the edges 11, 12 of the obstacle 10 does not exceed the permissible longitudinal slope of the bridge 1 after it has been laid, the laying vehicle 2 automatically carries out the laying operation.

Otherwise, the laying operation is discontinued. The laying vehicle 2 drives back or looks for a more suitable place for the laying operation. In any event, the laying vehicle 2 transmits the obstacle data to the pilot vehicle 6, 7, in which, if necessary, a decision can also be made about the use of other bridge systems.

Figure 4:
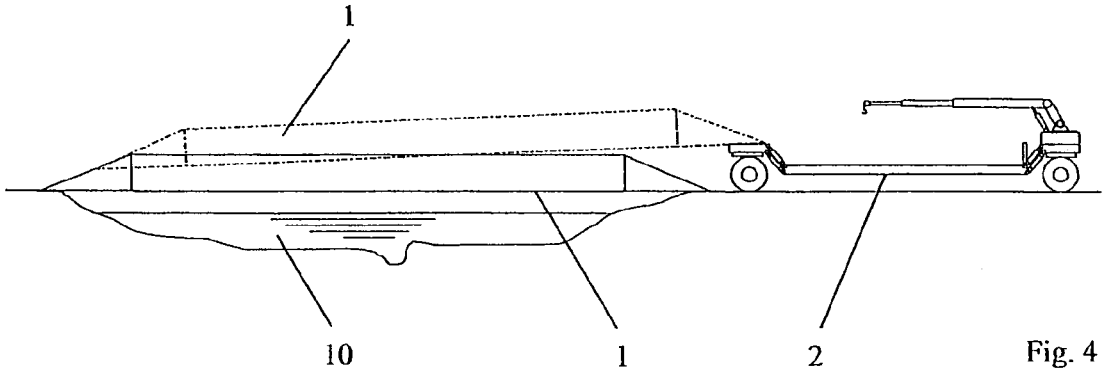
FIG. 4 shows the bridge laid over the obstacle.

FIG. 4 shows the obstacle 10 overcome with the bridge 1. The laying operation itself is symbolized by the bridge 1' drawn with broken lines. The bridge 1 and laying vehicle 2 are not drawn to scale.

Figure 5:
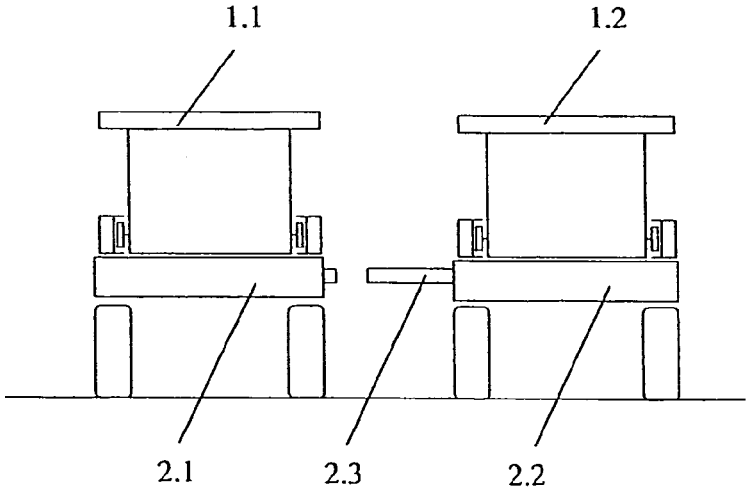
FIG. 5 shows two laying vehicles, each loaded with one half of a bridge.

FIG. 5 is a purely schematic drawing, which shows that it is possible to divide the bridge into two longitudinal halves 1.1, 1.2 and to transport each half of the bridge 1.1, 1.2 on its own laying vehicle 2.1, 2.2. Since each combination of half a bridge 1.1, 1.2 and laying vehicle 2.1, 2.2 now must conform only by itself to the tunnel profiles, road profiles, and other profiles, the dimensions can be chosen suitably large.

The laying vehicles 2.1, 2.2 are equipped with coupling devices 2.3, by which they can be coupled with each other at the edge of the combat zone. In the coupled state, the laying vehicles 2.1, 2.2 then drive to the obstacle, where the two halves of the bridge 1.1, 1.2 are laid either simultaneously or successively.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A method for laying a military bridge over an obstacle in a combat zone using at least one laying vehicle, comprising the steps of:

loading the bridge on at least one self-propelled, unmanned, remote-controlled laying vehicle;

transporting the loaded laying vehicle by water, air, rail, and/or road to an edge of the combat zone;

guiding the at least one laying vehicle by a manned pilot vehicle to the vicinity of the obstacle;

automatically advancing the at least one laying vehicle under slow approach to the obstacle, supported by optical determination of surroundings and/or laser scanner determination of the surroundings;

scanning the topographical situation with a topographical scanning system;

generating a simulation of a laying operation, taking into consideration scanner data and predetermined design limits;

formulating a decision about whether to carry out or break off the laying operation, and executing the decision.

2. The method in accordance with claim 1, wherein the transporting step includes transporting to the edge of the combat zone by transport vehicles driven by personnel according to rules of civil roadway traffic.

3. The method in accordance with claim 1, wherein the transporting step includes transporting to the edge of the combat zone by a cargo plane.

4. The method in accordance with claim 1, wherein the transporting step includes transporting to the edge of the combat zone by a barge.

5. The method in accordance with claim 1, wherein the laying vehicle follows a single pilot vehicle, and the pilot vehicle finds an optimum site for laying the bridge.

6. The method in accordance with claim 1, wherein the laying vehicle follows a group of pilot vehicles, one of the pilot vehicles finds an optimum site for laying the bridge, and the laying vehicle drives to the optimum site for laying the bridge by automatically following a recorded movement profile of the one pilot vehicle.

7. The method in accordance with claim 5, wherein the laying vehicle follows the pilot vehicle without mechanical connection.

8. The method in accordance with claim 6, wherein the laying vehicle follows the group of pilot vehicles without mechanical connection.

9. The method in accordance with claim 1, wherein the slow approach is made at reduced speed and, finally, at incremental speed.

10. The method in accordance with claim 9, wherein the laying vehicle performs an inspection of the laid bridge.

11. The method in accordance with claim 1, and further comprising the step of discontinuing the approach in the combat zone as soon as the optical and/or laser scanning and topographical scanning detect a gradient in local terrain that is too great for the laying vehicle to negotiate.

12. The method in accordance with claim 11, including switching the topographical scanning system to short distance, and resuming or continuing the approach.

13. The method in accordance with claim 1, and further comprising the steps of discontinuing the slow approach to the obstacle as soon as the topographical scanning system detects the correct position for laying the bridge, performing a fine scan in the current position, and starting the laying simulation.

14. The method in accordance with claim 1, including transporting the bridge in two longitudinally divided parts to the edge of the combat zone.

15. The method in accordance with claim 5, including wirelessly transmitting topographical scanning data to a pilot vehicle, and wirelessly transmitting command data from the pilot vehicle to the laying vehicle.

16. The method in accordance with claim 6, including wirelessly transmitting topographical scanning data to a pilot vehicle, and wirelessly transmitting command data from the pilot vehicle to the laying vehicle.

* * * * *